US011827324B1

(12) United States Patent
Tate et al.

(10) Patent No.: US 11,827,324 B1
(45) **Date of Patent: *Nov. 28, 2023**

(54) TROLLING MOTOR AND FOOT PEDAL FOR TROLLING MOTOR

(71) Applicant: Brunswick Corporation, Mettawa, IL (US)

(72) Inventors: Robert S. Tate, Lowell, MI (US); Brian C. Scott, Comstock Park, MI (US); John Witte, Ada, MI (US); Eric S. Deuel, Allendale, MI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/477,836

(22) Filed: Sep. 17, 2021

Related U.S. Application Data

(63) Continuation of application No. 16/722,696, filed on Dec. 20, 2019, now Pat. No. 11,155,327.

(60) Provisional application No. 62/783,438, filed on Dec. 21, 2018.

(51) Int. Cl.

| | |
|---|---|
| ***B63H 20/00*** | (2006.01) |
| ***B63H 25/02*** | (2006.01) |
| ***B63H 25/04*** | (2006.01) |
| ***B63H 20/12*** | (2006.01) |

(52) U.S. Cl.
CPC ..... *B63H 20/007* (2013.01); *B63H 20/12* (2013.01); *B63H 25/02* (2013.01); *B63H 25/04* (2013.01); *B63H 2025/045* (2013.01)

(58) Field of Classification Search
CPC ..... B63H 20/00; B63H 20/007; B63H 20/12; B63H 25/00; B63H 25/02; B63H 25/04; B63H 2025/045
USPC ..... 440/7
See application file for complete search history.

(56) References Cited

U.S. PATENT DOCUMENTS

| | | | |
|---|---|---|---|
| 5,078,070 | A | 1/1992 | Clement |
| 5,129,845 | A | 7/1992 | Henderson |
| 5,171,173 | A | 12/1992 | Henderson et al. |
| 5,180,925 | A | 1/1993 | Lieb |
| 6,054,831 | A | 4/2000 | Moore et al. |
| 6,468,117 | B1 | 10/2002 | Healey |

(Continued)

OTHER PUBLICATIONS

Motorguide, "Product Guide", brochure, 2003, 13 pages.

(Continued)

*Primary Examiner* — Lars A Olson
(74) *Attorney, Agent, or Firm* — ANDRUS INTELLECTUAL PROPERTY LAW, LLP

(57) ABSTRACT

A trolling motor has a steering motor transmitting torque to a steering shaft, which is coupled to a lower propulsion unit such that rotation of the steering shaft rotates the propulsion unit about a steering axis. A controller is in signal communication with the steering motor. A foot pedal in signal communication with the controller has a foot pad pivotable about a pivot axis and sends electrical steering signals to the controller (and thus steering motor) in response to pivoting of the foot pad. A variable resistance device is coupled to the foot pedal and controllable to vary resistance to pivoting of the foot pad about the pivot axis based on a position, velocity, acceleration, and/or jerk of the steering shaft. Additionally or alternatively, the variable resistance device provides haptic feedback to a user via the foot pad to inform the user about information related to the trolling motor system.

18 Claims, 4 Drawing Sheets

(56) References Cited

U.S. PATENT DOCUMENTS

| | | | |
|---|---|---|---|
| 6,507,164 | B1 | 1/2003 | Healey et al. |
| 6,667,934 | B1 | 12/2003 | Healey |
| 9,160,210 | B2 | 10/2015 | Perry |
| 9,168,851 | B1 | 10/2015 | Sutter et al. |
| 9,676,462 | B2 | 6/2017 | Bernloehr et al. |
| 9,908,606 | B1 | 3/2018 | Andrasko et al. |
| 9,994,296 | B1 | 6/2018 | Balogh et al. |
| 10,336,425 | B2 | 7/2019 | Laster |
| 10,604,222 | B1 | 3/2020 | Salisbury et al. |
| 10,884,416 | B2 | 1/2021 | Whiteside et al. |
| 2010/0116190 | A1 | 5/2010 | Ito |
| 2015/0051607 | A1 | 2/2015 | Hajishah et al. |
| 2019/0176950 | A1 | 6/2019 | Whiteside et al. |

OTHER PUBLICATIONS

Tate et al., "Trolling Motor And Foot Pedal For Trolling Motor," U.S. Appl. No. 16/722,696, filed Dec. 20, 2019 (specification and drawings only).

TROLLING MOTOR AND FOOT PEDAL FOR TROLLING MOTOR

CROSS-REFERENCE TO RELATED APPLICATIONS

This application is a continuation of U.S. application Ser. No. 16/722,696, filed Dec. 20, 2019, which claims the benefit of U.S. Provisional Application No. 62/783,438, filed Dec. 21, 2018, both of which applications are hereby incorporated herein by reference in their entireties.

FIELD

The present disclosure relates to electric trolling motors and to foot pedals for controlling steering and thrust of trolling motors.

BACKGROUND

U.S. Pat. No. 6,468,117 discloses a foot control unit for controlling the directional orientation of a trolling motor. The foot control unit includes an upper pivotal foot pedal and a lower flat base member to which the foot pedal is pivotally attached. The foot control unit further includes an offset hinge consisting of an upper hinge member pivotally attached at a first end thereof to the foot pedal and a lower hinge member pivotally attached at a first end thereof to the base member, the hinge members being pivotally attached to each other at respective ends thereof which are opposite from said first ends thereof, and a detent mounted on the offset hinge unit and responsive to a predetermined degree of pivotal movement of the upper hinge member with respect to the lower hinge member to provide a temporary stop in the pivotal movement.

U.S. Pat. No. 6,667,934 discloses a sonar system, and a digital sonar transducer for use with the inventive system, in which transmitter and receiver circuitry are remote to the sonar display unit. In a preferred embodiment the digital sonar transducer includes: a housing; an acoustic transducer housed within the housing; transmitter circuitry for driving the acoustic transducer; receiver circuitry for conditioning received echoes; and a computing device for receiving commands from a display unit, processing received echoes, and sending echo information to the display unit. The display unit of the inventive system is configured to receive echo information from the digital sonar transducer and display sonar information to an operator.

U.S. Pat. No. 9,994,296 discloses a user input device for controlling steering and/or propulsion of a marine vessel including a movable member movable by a vessel operator to control the steering and/or propulsion of the marine vessel, a variable resistance device controllable to vary resistance to movement of the movable member, and a controller that controls the variable resistance device. The controller is configured to detect an unstable condition indicator and, upon detecting the unstable condition indicator, control the variable resistance device to increase resistance to movement of the movable member.

U.S. Pat. No. 9,908,606 discloses a drive-by-wire control system for steering a propulsion device on a marine vessel including a steering wheel that is manually rotatable and a steering actuator that causes the propulsion device to steer based upon rotation of the steering wheel. The system further includes a resistance device that applies a resistance force against rotation of the steering wheel, and a controller that controls the resistance device to vary the resistance force based on at least one sensed condition of the system.

The above patents are hereby incorporated by reference in their entireties.

SUMMARY

According to one example, in a steer-by-wire trolling motor system, the position, velocity, acceleration, and/or jerk of a trolling motor foot pedal and/or trolling motor steering shaft are used to control a variable resistance device that provides damping/resistance to movement of the foot pedal's pad. This provides feedback to the operator, via the foot pedal, that simulates the feel of a cable-steer trolling motor system.

According to another example, a trolling motor system includes a trolling motor having a steering motor coupled in torque transmitting relationship with a steering shaft, the steering shaft being coupled to a lower propulsion unit such that rotation of the steering shaft results in rotation of the lower propulsion unit about a steering axis. A controller is in signal communication with the steering motor. A foot pedal is in signal communication with the controller. The foot pedal has a foot pad pivotable about a pivot axis and is configured to send electrical steering signals to the controller in response to pivoting of the foot pad to thereby control the steering motor. A variable resistance device is coupled to the foot pedal and controllable to vary resistance to pivoting of the foot pad about the pivot axis based on at least one of a position, velocity, acceleration, and jerk of the steering shaft about the steering axis.

According to another example, haptic feedback to the operator may be provided via the pedal or via a remote control FOB to notify the operator of sonar, GPS, or battery-related information. For example, one or both of the foot pedal may be configured to provide vibrational feedback to notify an angler of various situations, such as approaching a submerged object based on sonar, marking a fish based on sonar, reaching a depth threshold based on sonar, losing a GPS signal based on GPS information, approaching a pre-set GPS destination, or exceeding a maximum deviation from a set route based on GPS information. Wireless charging may also be provided by providing one or more wireless charging pads on the vessel in order to power and charge the wireless pedal.

According to another example, a trolling motor system includes a trolling motor having a steering motor coupled in torque transmitting relationship with a steering shaft, the steering shaft being coupled to a lower propulsion unit such that rotation of the steering shaft results in rotation of the lower propulsion unit about a steering axis. A controller is in signal communication with the steering motor. A foot pedal is in signal communication with the controller. The foot pedal has a foot pad pivotable about a pivot axis and is configured to send electrical steering signals to the controller in response to pivoting of the foot pad to thereby control the steering motor. A variable resistance device is located on the foot pedal and controllable to provide haptic feedback to a user via the foot pad to inform the user about information related to the trolling motor system.

DETAILED DESCRIPTION

Figure 1:
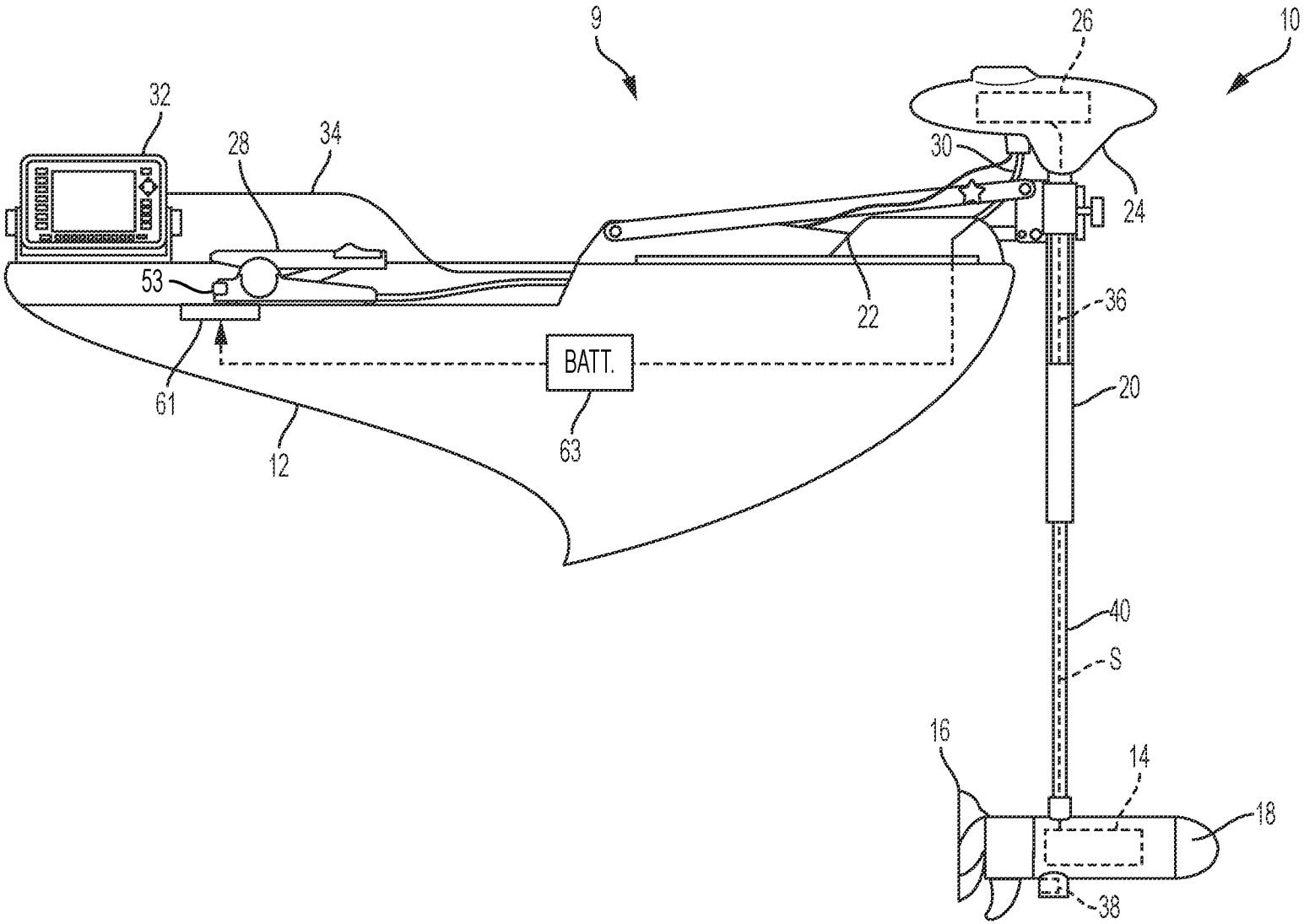
FIG. 1 illustrates a marine vessel equipped with a trolling motor system.
Figure 4:
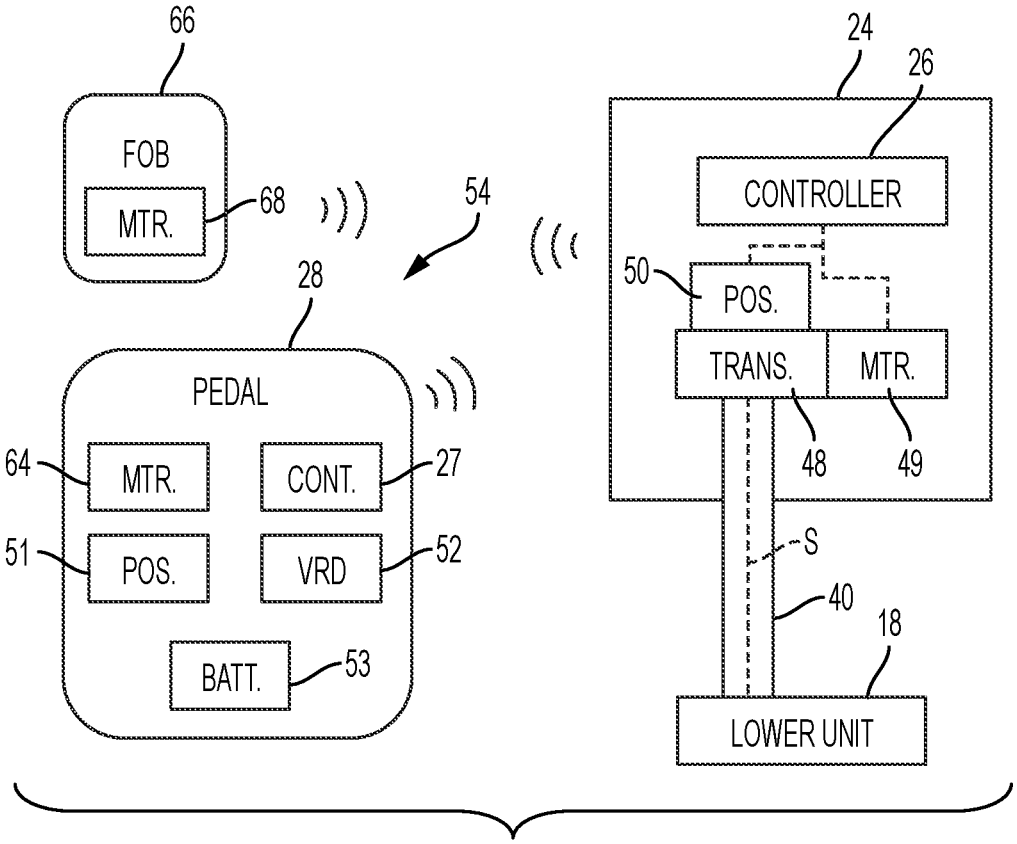
FIG. 4 illustrates one example of a trolling motor system according to the present disclosure.

FIG. 1 illustrates an example of a trolling motor system 9 including a trolling motor 10, which is removably attached to a marine vessel 12. The trolling motor 10 includes an electric motor 14 coupled to and configured to rotate a propeller 16, both of which are held by a lower propulsion unit 18 of the trolling motor 10. A support column 20 supports the lower propulsion unit 18 from a mounting bracket 22 connected to the marine vessel 12. A head unit 24 is mounted to the upper end of the support column 20 and houses a controller 26. In operation, the speed and steering direction of the trolling motor 10 are controlled by a foot pedal 28 in signal communication with the controller 26 of the trolling motor 10 by way of a control cable or wireless protocol. The trolling motor 10 may also be controlled by an electronic input device 32, such as a fish finder or chart plotter, connected to the controller 26 by way of control cable 34. In another example, the trolling motor 10 may be controlled by way of a hand-held remote control (for example, a FOB 66 as shown in FIG. 4). In some examples, electronic input device 32 and/or remote control wirelessly communicate with the controller 26.

The controller 26 is electrically connected to the electric motor 14 by way of a cable 36 extending through the support column 20. By way of the electrical connection provided by cable 36, the controller 26 controls a speed and direction (forward or reverse) of the electric motor 14 and thus a speed and direction of the propeller 16 driveably coupled thereto. The speed and direction of the propeller 16 can be selected by way of a user input device, such as the foot pedal 28 or hand-held remote control, in signal communication with the controller 26. The controller 26 may also be coupled to a sonar 38 located on/in the lower propulsion unit 18 by way of the cable 36.

Figure 5:
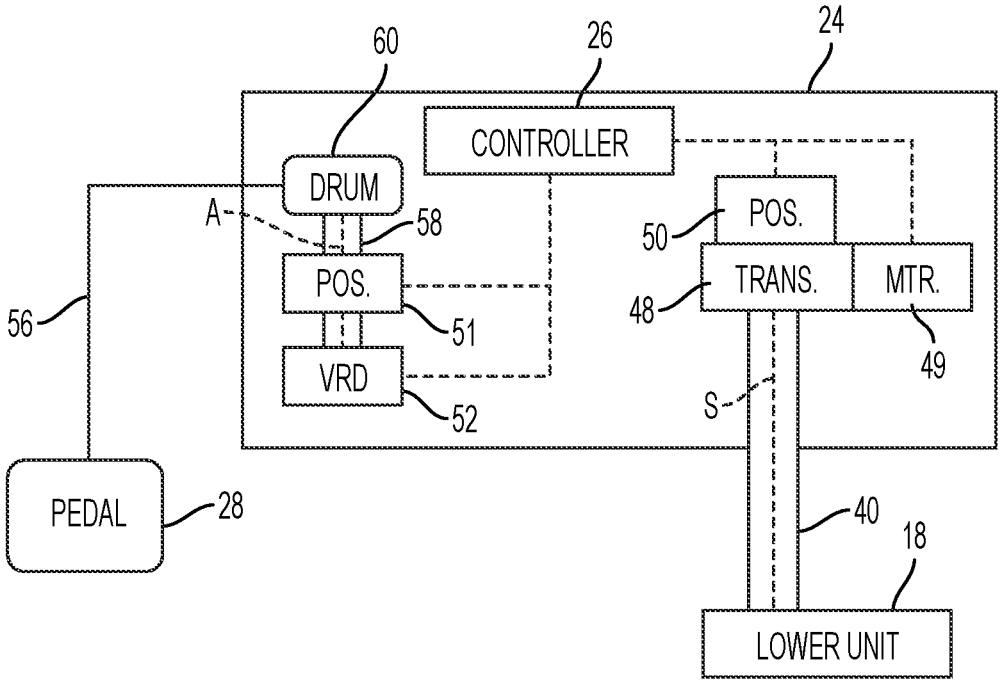
FIG. 5 illustrates another example of a trolling motor system.

The trolling motor 10 is steered in response to signals from the foot pedal 28, electronic input device 32, and/or hand-held remote control, which signals the controller 26 interprets and uses to control a steering motor 49 with which the controller 26 is in signal communication (FIGS. 4, 5), which may be located in the head unit 24. The steering motor 49 is coupled in torque transmitting relationship with a steering shaft 40 of the trolling motor 10, either directly or by way of a transmission 48 (FIGS. 4, 5). The steering shaft 40 is coupled to the lower propulsion unit 18 such that rotation of the steering shaft 40 results in rotation of the lower propulsion unit 18 about a steering axis S to change an angle of thrust produced by the trolling motor 10 with respect to the marine vessel 12. Other configurations for the trolling motor 10 are contemplated, including ones in which a separate steering module is located remote from the head unit 24 (see FIG. 7) and/or the support column 20 and steering shaft 40 are integral with one another.

Traditional steer-by-wire proportional-steer systems for trolling motors do not provide realistic feedback to an operator at the foot pedal 28. The rotating inertia of the trolling motor's lower propulsion unit 18 is not felt, and the operator is often able to move the foot pedal 28 at a rate that is different than the rate at which the lower propulsion unit 18 of the trolling motor 10 rotates. Some current foot pedals provide frictional resistance at the foot pedal 28, but the friction device does not provide an "active" feel to the operator. For example, if the operator tries to steer the trolling motor 10 faster, the friction device does not increase the rotational resistance of the foot pedal 28.

The present inventors have therefore developed assemblies and algorithms for providing variable resistance to pivoting of the foot pedal 28, which variable resistance is proportional to or otherwise based on a position, speed, acceleration, and/or jerk of the foot pedal 28 and/or steering shaft 40.

Figure 2:
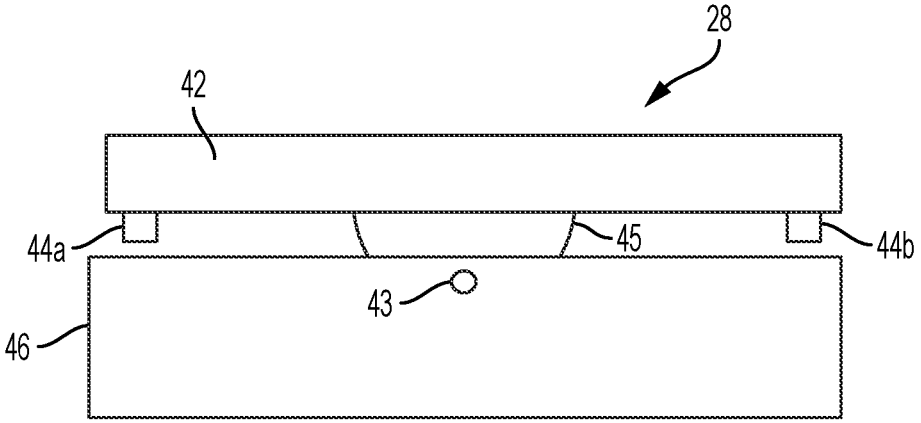
FIG. 2 is a schematic of one example of a foot pedal according to the present disclosure.
Figure 3:
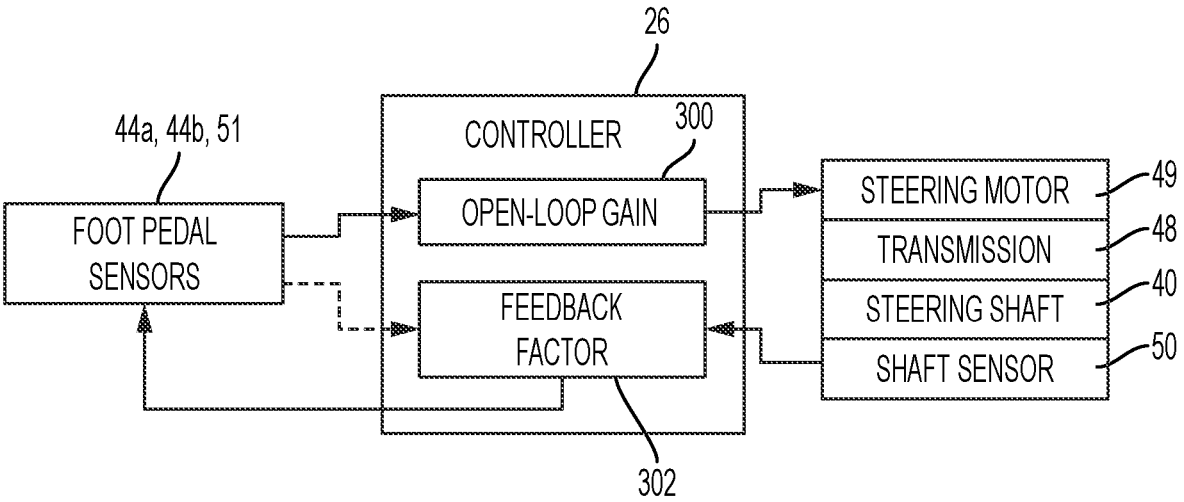
FIG. 3 is a schematic of a control algorithm according to the present disclosure.
Figure 6:
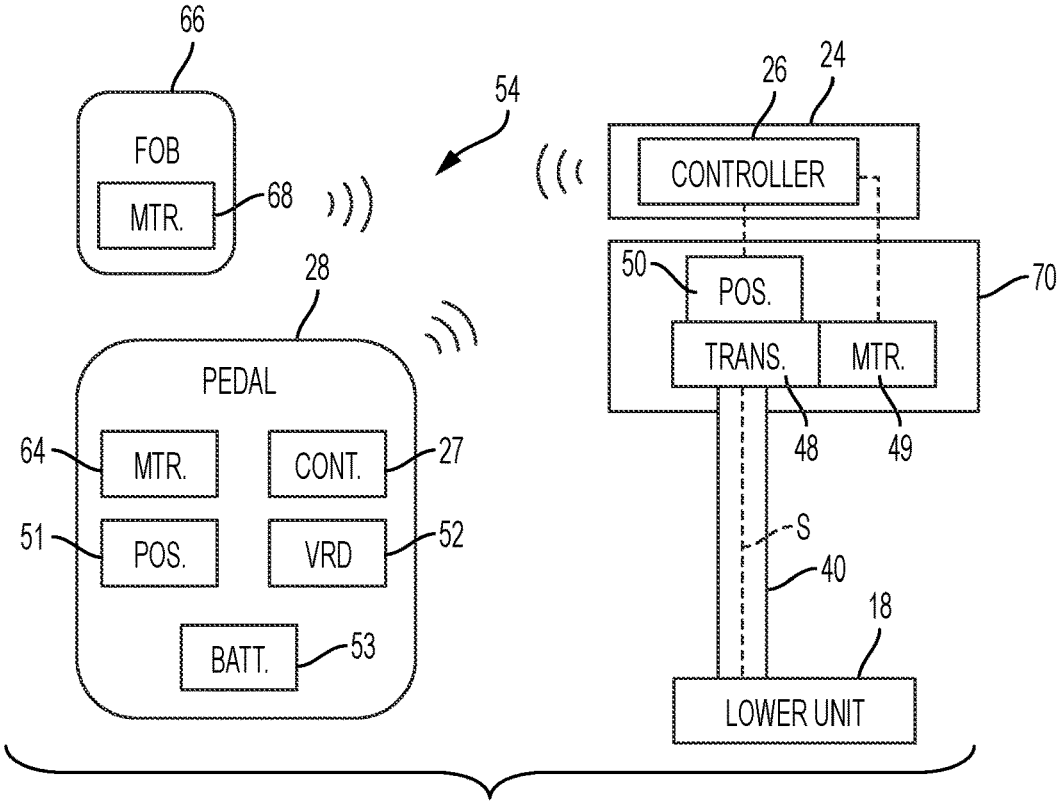
FIG. 6 illustrates another example of a trolling motor system.
Figure 7:
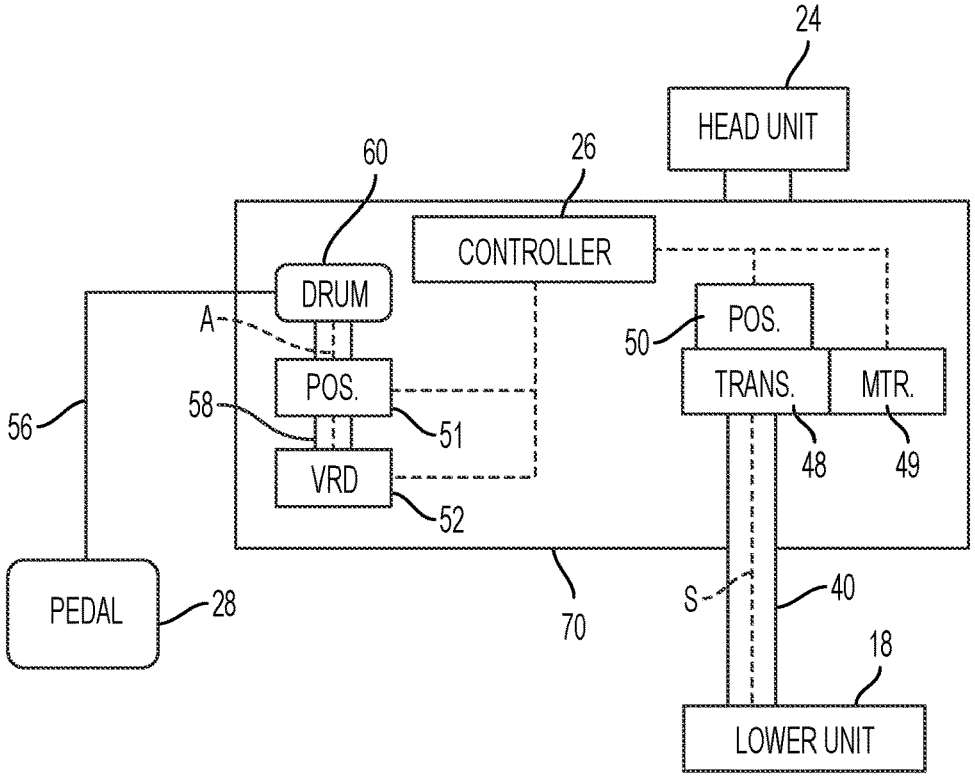
FIG. 7 illustrates another example of a trolling motor system.

Referring to FIG. 2, the foot pedal 28 has a foot pad 42 pivotable about a pivot axis 43 and being configured to send electrical steering signals to the controller 26 in response to pivoting of the foot pad 42 to thereby control the steering motor 49 and, if applicable, the transmission 48. As the operator rotates a foot pad 42 of the foot pedal 28 through a steering cycle, sensors 44*a*, 44*b* mounted in the foot pedal 28 provide position measurements to the controller 26, which synchronizes the position of the lower propulsion unit 18 with the position of the foot pad 42. The open-loop gain the controller 26 uses to correlate input signals from the sensors 44*a*, 44*b* to output signals to the steering motor 49 is shown in FIG. 3 at 300. Various open-loop electrical steering algorithms, as well as the types and placements of sensors 44*a*, 44*b* that can be used in a trolling motor foot pedal, are well known in the art and will therefore not be described herein for brevity's sake. However, the present inventors have discovered the benefits of additionally using feedback 302 related to the position, velocity, acceleration, and/or jerk of the foot pad 42 or the steering shaft 40 to calculate damping and/or resistance to be provided at the foot pedal 28. The steering resistance experienced by the operator at the foot pedal 28, similar in feel to the feedback experienced when the trolling motor 10 is steered by way of a mechanical cable connection, is achieved by way of a variable resistance device 52, such as a damper, gas spring, electric motor, or magnetorheological fluid system described hereinbelow, which variable resistance device 52 may be housed in the foot pedal 28 (such as in the base 46 thereof) as shown in FIGS. 4 and 6, in the head unit 24 of the trolling motor 10 as shown in FIG. 5, or in a mounting bracket 70 as shown in FIG. 7.

As noted, the variable resistance device 52 is coupled to the foot pedal 28 and controllable to vary resistance to pivoting of the foot pad 42 about the pivot axis 43 based on at least one of the position, velocity, acceleration, and jerk of the steering shaft 40 about the steering axis S. In one example, the variable resistance device 52 is a linear or rotary damper or a gas spring coupled between moving parts in the foot pedal 28, the head unit 24, or the mounting bracket 70. The damper provides an active feel, as the damping force increases as the operator attempts to steer the trolling motor 10 more quickly, thereby simulating inertial resistance. In another example, the variable resistance device 52 is an electric motor directly coupled (or coupled via a transmission) to a moving part of the foot pedal 28, the head unit 24, or the mounting bracket 70. The electric motor is either powered to resist rotation of the steering system or shorted out to provide dynamic braking to the system. A controller (such as the controller 26 in the head unit 24 or a separate controller 27 in the foot pedal 28) may vary the resistance provided by the electric motor based on a control algorithm. The control algorithm may be designed to sense the steering force or intended acceleration of the system, which the control algorithm then uses to simulate the inertial steering resistance. The electric motor may also be used to keep the foot pad's position synchronized with the lower unit's orientation when remote control or autopilot modes are enabled, and the operator is not steering the trolling motor 10 with the foot pedal 28. In yet another example, the variable resistance device 52 is a magnetorheological fluid system in signal communication with a controller. By controlling current to an electromagnet in proximity to the magnetorheological fluid, the controller 26 or 27 varies the resistance of the magnetorheological fluid to adjust the resistance between moving parts in the foot pedal 28, the head unit 24, or the mounting bracket 70.

According to one example, as shown in FIG. 4, the variable resistance device 52 is provided in the foot pedal 28. In this example, no cables connect the trolling motor's head unit 24 to the foot pedal 28, and only wireless signals 54 are sent between the head unit 24 and the foot pedal 28. Wireless signals 54 between the head unit 24 (i.e., the controller 26 therein) and the foot pedal 28 may be by any of various wireless means, such as via Bluetooth, Bluetooth low energy, ZigBee, or other wireless protocol. However, in other examples, an electrical cable connects the foot pedal 28 to the head unit 24, but no mechanical steering connections (e.g., push-pull, pull-pull, Bowden wires) are provided between the foot pedal 28 and the head unit 24. A position sensor 50 on the transmission 48 or steering shaft 40 senses an angular position of the steering shaft 40 about the steering axis S. The position sensor 50 is in signal communication with and sends position information to the controller 26 located in the head unit 24, which controller 26 then sends wireless signals 54 to the controller 27 in the foot pedal 28. Either the controller 26 in the head unit 24 or the controller 27 in the foot pedal 28 uses measurements from the position sensor 50 to determine the at least one of the position, velocity, acceleration, and jerk of the steering shaft 40 and thereafter to determine an amount of damping/resistance that the variable resistance device 52 should provide. Alternatively or additionally, a position (and therefore velocity, acceleration, and/or jerk) of the foot pad 42 itself may be measured by way of a position sensor 51 (which could be the same as sensors 44*a*, 44*b*, FIG. 2) located in the foot pedal 28 and thereafter used to determine the amount of damping or resistance that the variable resistance device 52 should provide.

With reference to FIGS. 2 and 4, if the variable resistance device 52 is a rotary damper, the variable resistance device 52 could be provided about the pivot axis 43 of the foot pad 42 with respect to the base 46. If the variable resistance device 52 is a linear damper or a gas spring, the variable resistance device 52 could be provided on an arm 45 connecting the foot pad 42 to the base 46. If the variable resistance device 52 is a magnetorheological fluid system, it can also be provided about the pivot axis 43 or on the arm 45, and can provide selective damping to rotary or linear movement, respectively. If the variable resistance device 52 is an electric motor used to dynamically vary the resistance to steering input at the foot pad 42, it can directly drive the foot pad 42 or be coupled thereto by way of a transmission.

In another example, as shown in FIG. 5, the variable resistance device 52 is located on or within the trolling motor 10. Mechanical cables 56, which are taken up and let out as the foot pad 42 pivots about the pivot axis 43 (much the same as in a mechanical steering system), couple the foot pedal 28 to the variable resistance device 52. More specifically, a secondary shaft 58 is located on or in the trolling motor 10 that is separate from the steering shaft 40 and rotatable about a secondary axis A. Unlike a mechanical steering system, the mechanical cables 56 are not used to transmit mechanical steering input from the foot pedal 28 to the steering shaft 40, but are used instead only to turn a secondary shaft 58 that has a position sensor 51 and the variable resistance device 52 coupled to it. The secondary shaft 58 is located in the head unit 24 and is coupled to a cable drum 60 that is rotatable with the secondary shaft 58, around which cable drum 60 the mechanical cables 56 are wound. The controller 26 controls the variable resistance device 52 to provide variable resistance to rotation of the secondary shaft 58 about the secondary axis A. Any damping/resistance provided by the variable resistance device 52 is transferred to the foot pedal 28 via the mechanical cables 56. Because the mechanical cables 56 are coupled to the cable drum 60, the variable resistance to rotation of the secondary shaft 58 is transmitted to the taking up and letting out of the cables 56 as the foot pad 42 pivots. The trolling motor's steering shaft 40 may be driven directly by the steering motor 49 or by way of the transmission 48 coupling the steering motor 49 to the steering shaft 40, in response to electrical steering signals from the foot pedal 28, which may be wired or wireless. The steering shaft 40 or transmission 48 is fitted with or coupled in signal communication with a position sensor 50, such as an encoder or potentiometer, to determine shaft position. In this example, the steering motor 49 and steering transmission 48 are not mechanically coupled to the secondary shaft 58. Rather, signals from the position sensor 50 coupled to the transmission 48 are sent to the controller 26, which uses an algorithm to determine an amount of damping or resistance that the variable resistance device 52 should provide.

In the examples of both FIGS. 4 and 5, the controller 26 can calculate the steering damping or resistance that is eventually provided to resist pivoting of the foot pad 42 based on the measured position and/or derived speed, acceleration, and/or jerk of the foot pedal 28 and/or steering shaft 40. For example, a dynamic systems model may be derived to define an algorithm that tells the variable resistance device 52 to provide varying levels of resistance. These varying levels of resistance are programmed to simulate the feel (i.e., inertial resistance) of a standard cable-steer trolling motor. For example, the controller 26 may be programmed to calculate the speed, acceleration, and/or jerk of the foot pad 42 and/or steering shaft 40 by calculating the first, second, and/or third derivatives, respectively, of the angular position of the foot pad 42 about the pivot axis 43 and/or the steering shaft 40 about the steering axis S as measured by the position sensors 51 and/or 50 over time. The controller 26 may have a memory containing a look-up table, other type of input-output map, or a series of equations that accepts the position, speed, acceleration, and/or jerk of the foot pad 42 and/or steering shaft 40 as an input, and outputs a desired resistance force against pivoting of the foot pad 42. In one example, the resistance may increase as the speed, acceleration, and/or jerk of the foot pad 42 and/or steering shaft 40 increases.

In the example of FIG. 4, sensors in the foot pedal 28 read the angular position of the foot pad 42 about the pivot axis 43, which position can be used to derive pedal input speed, acceleration, and jerk. The sensors 44*a*, 44*b* can be in the form of those provided on a known floating foot pad 42 that reads input from the user, or in the form of an encoder (position sensor 51) that senses the entire pad's motion. The sensors 44*a*, 44*b*, 51 provide information to a controller 27, which provides an output to the variable resistance device 52 that is proportional or otherwise related to the speed, acceleration, and/or jerk of the foot pedal 28. In an alternative embodiment, the angular position of the steering shaft 40 is used to derive steering shaft input speed, acceleration, and jerk. The position sensor 50 provides information to the controller 26, which provides an output to the variable resistance device 52 that is proportional or otherwise related to the speed, acceleration, and/or jerk of the steering shaft 40.

In the example of FIG. 5, the steering resistance provided to the foot pedal 28 is based on rotational speed, acceleration, and/or jerk of the trolling motor's steering shaft 40. The signal from the position sensor 50 is used to derive such speed, acceleration, and/or jerk of the steering shaft 40. These calculations are used to inform an algorithm carried out by the controller 26, which controls the variable resistance device 52 and therefore the amount of resistance to pivoting felt at the foot pedal 28 due to the mechanical cables 56 connected between the secondary shaft 58 and the foot pedal 28. Measuring the velocity, acceleration, and/or jerk of the trolling motor's steering shaft 40 to control the variable resistance device 52 eliminates any lag of the lower propulsion unit 18 and/or steering shaft 40 position relative to the position of the foot pad 42. Thus, any difference between the lower propulsion unit 18 position and the foot pedal 28 position is unnoticeable to the operator at any given point in time.

Providing the variable resistance device 52 in the trolling motor's head unit 24 can provide benefits in that the size of the foot pedal 28 is reduced. Packaging space in the foot pedal well is often limited, and it might not be desirable to have the foot pedal 28 be made taller. Additionally, electronic components in the head unit 24 are not subject to water intrusion as much as electronic components in the foot pedal well (where water collects) would be. Furthermore, trolling motor head units often already have electronics packaged therein, so the additional electronics required to provide the above-noted functionality could be added to an already existing circuit board (i.e., the controller 26).

Referring again to FIG. 4, a motor 64 may also be provided in the foot pedal 28. This can be the same motor as that which provides damping/resistance in the instance that the variable resistance device 52 is an electric motor located on the foot pedal 28, or alternatively both the motor 64 and a non-motor variable resistance device 52 can be provided. The motor 64 is configured to change a position of the foot pad 42 about the pivot axis 43 (directly or by way of a transmission) in order to synchronize the position of the foot pad 42 to the position of the steering shaft 40 and the lower propulsion unit 18. In other words, the electric motor 52 or 64 positions the foot pad 42 about the pivot axis 43 to correspond to the sensed position of the steering shaft 40 as determined by the position sensor 50. Therefore, even while the trolling motor system 9 is operating in a remote control or an automatic mode, in which the trolling motor 10 is steered by way of a remote control (FOB) 66 or a program on the electronic input device 32, the position of the foot pedal's pad 42 can be matched to the position of the lower unit 18. This avoids the need for a delay, during which the foot pad 42 moves to match the position of the lower propulsion unit 18, after the remote control or automatic mode is canceled (such as by way of the operator applying pressure to the foot pedal 28). The position of the steering shaft 40 can be read by the position sensor 50 and used by the controller 26 and/or 27 to position the foot pedal's pad 42 about the pivot point 43, as part of the feedback process shown at 302 in FIG. 3.

Generally, professional and competitive anglers want to focus their attention on fishing, not on trolling motor operation, avoidance of submerged objects or shallow water, or navigation. Adding functionality to a foot pedal 28 or FOB 66 to pass information of interest to the angler can enhance his or her on-water experience, allowing the angler to focus on fishing rather than trolling motor or navigation control. In one embodiment, the foot pedal 28 is configured to provide haptic feedback, such as a vibration, in order to alert the user of one or more environmental conditions or to alert the user regarding the status of the trolling motor 10 and/or the trolling motor system 9.

For example, haptic feedback may be utilized to signal information to the user regarding objects or thresholds detected via sonar 38, information relating to the GPS location of the marine vessel 12 or the GPS signal received at the electronic input device 32, or information about the status of the trolling motor 10 or various control devices connected thereto. Regarding sonar, the haptic feedback at the foot pedal 28 may be utilized to communicate information to a user regarding the marine environment. For instance, the haptic feedback might be utilized to signal detection of certain objects or conditions via sonar 38, such as detection that the marine vessel 12 is approaching a submerged object or that a fish has been located via sonar 38, or that the vessel 12 has reached a pre-set depth. In another example, haptic feedback may be utilized to communicate to the user that a particular GPS location has been reached or will soon be reached, or that a GPS signal has been lost and the operator's attention should be directed towards navigation. Similarly, haptic feedback may be utilized to communicate information about the vessel's location, such as to provide a warning that a maximum deviation from a set route or set GPS location has been exceeded.

Referring still to FIG. 4, the variable resistance device 52 and/or the motor 64 may be utilized to provide haptic feedback to a user operating the foot pedal 28. In one embodiment, the variable resistance device 52 may be operated to provide a pulsed resistance or pulsed damping which will be felt by the user applying pressure to the foot pad 42. In another embodiment, the motor 64 may be configured to induce a slight pulsation or vibrational movement of the foot pad 42—e.g. by moving the foot pad 42 in short rhythmic pulses. In still other embodiments, vibrational feedback may be provided by a third motor in or on the foot pedal 28, such as a small motor connected to an eccentric weight to create a vibration (i.e., a rotary electric vibrator).

The controller 26 or 27 is configured to control the variable resistance device 52 and/or the motor 64 to provide haptic feedback to the user via the foot pad 42 to inform the user about information related to the trolling motor system 9, including but not limited to a non-steering related status of at least one of the trolling motor 10 and the foot pedal 28. When an electronic input device 32 is provided in signal communication with the controller 26 and/or 27, the controller 26 or 27 is configured to control the variable resistance device 52 and/or the motor 64 to provide haptic feedback to the user via the foot pad 42 to inform the user about information obtained by the electronic input device 32. In one embodiment, the controller 26 determines that a feedback pulse or vibration should be generated based on GPS or sonar information provided by the electronic input device 32 and sends a control signal, such as a wireless signal 54, to control one or more devices within the foot pedal 28, such as the motor 64 or the variable resistance device 52. For example, the controller 26 may receive alerts or status information from the electronic input device 32 determined based on the signals from the sonar 38, such as a notification that a threshold depth has been reached or a fish is detected. Likewise, the controller 26 may receive information from a GPS module, such as software within the electronic input device 32, comparing GPS location information to control information, such as target routes or an assigned GPS position. For example, the controller 26 may receive notice from the electronic input device 32 when the GPS location of the marine vessel 12 is more than a threshold distance from an assigned route or GPS location.

The controller 26 may then communicate instructions to the various devices in the foot pedal 28 in order to generate appropriate feedback. The controller 26 may then generate the control signals in order to provide appropriate haptic feedback at the foot pedal 28. In certain embodiments, the controller 26 may be configured to assign different haptic feedback patterns, such as different vibration patterns, to signal different information to the operator. To provide just one example, a short vibration pulse (or series of short pulses) may be used to signal a fish or a threshold depth and a long vibration pulse (or series of long pulses) may be used to indicate GPS-related information, such as loss of GPS signal or an off-course alert. In still other embodiments, the foot pedal 28 may include its own controller 27 configured to receive information from the controller 26 in the head unit 24 and to execute its own logic to control the feedback device(s) (e.g., variable resistance device 52 or motor 64) accordingly.

In the case where a remote control device is provided for the trolling motor system 9, the remote control device (such as the FOB 66) may have a motor 68 in signal communication with the controller 26, and the controller 26 is configured to control the motor 68 to provide haptic feedback to a user via the remote control device to inform the user about a status of and/or information related to the trolling motor system 9. More specifically, in certain embodiments in which the trolling motor 10 is steered by way of a remote control FOB 66, the FOB 66 may include a haptic feedback device, such as a small rotary electric vibrator or other vibration-generating motor 68. For example, while the trolling motor system 9 is operating in a remote control or an automatic mode, such as a waypoint tracking mode where the controller 26 and electronic input device 32 communicate with one another in order to automatically steer the trolling motor 10 and thus the marine vessel 12, the FOB 66 may be configured to generate navigation-related alerts. For example, the controller 26 may be configured to generate a control instruction to the FOB 66 to initiate a vibration within the FOB 66 as the marine vessel 12 approaches a pre-set GPS coordinate. Alternatively or additionally, the controller 26 may be configured to instruct vibration of the FOB 66 if a GPS signal is lost and thus manual control by the operator is advised. Wireless signals 54 between the head unit 24 (i.e., the controller 26 therein) and the FOB 66, as well as between the head unit 24 and the foot pedal 28 may be by any of various wireless means, such as via Bluetooth, Bluetooth low energy, ZigBee, or other wireless protocol.

Alternatively or additionally, where the foot pedal 28 is a battery-powered wireless device, feedback may be provided to signal information about a battery 53 within the foot pedal 28. For example, haptic feedback, such as vibrational motion, may be provided at the foot pedal 28 to signal that the battery 53 (which may also be multiple batteries) needs to be recharged or replaced. Battery life is often a concern for wireless trolling motor pedals. Current designs in production require frequent replacement of batteries because battery size has been minimized compared to the power demands of the pedal. Adding functionality to a pedal that consumes additional power either requires increasing the size of the battery (and thus the size of the pedal) or even more frequent replacement or recharging of the batteries in the pedal. Pedal size is a design issue, where smaller and more portable pedals are desired, and thus increasing the battery packaging space of the pedal is a significant design concern. Likewise, increasing the power consumption of the pedal without increasing the battery size, and thus requiring more frequent recharging or replacing of batteries, is also undesirable because it limits the usefulness of the pedal to the operator.

Moreover, the inventors have recognized that a wireless and mobile foot pedal 28 is desirable because it allows user flexibility regarding where to operate the trolling motor 10 and allows a user to move about the marine vessel 12 in order to optimize fishing while still being able to control the trolling motor 10. Thus, the inventors have recognized a need for a charging infrastructure on the marine vessel 12 that allows the user the flexibility of a wireless foot pedal 28 while also minimizing the size of the battery 53 required to operate all features of the foot pedal 28. Accordingly, the inventors have developed a wireless charging infrastructure for the foot pedal 28 wherein one or more wireless charging pads are positioned about the marine vessel.

As illustrated in FIG. 1, a wireless charging pad 61 configured to charge the battery 53 in the foot pedal 28 may be positioned, such as on the floor of the marine vessel 12, such that the operator can place the foot pedal 28 on the wireless charging pad 61 in order to charge the battery 53 and power continued operation of the foot pedal 28. In certain embodiments, multiple wireless charging pads 61 may be installed and/or placed at various locations on the marine vessel 12, which may be powered by a battery 63 on the marine vessel 12, such as that connected to the trolling motor 10. Thus, the foot pedal 28 may be placed on the wireless charging pad 61 in order to transfer charge from the larger battery 63 on the marine vessel 12 to the smaller battery 53 of the foot pedal 28, and thus provide power to continue operating the foot pedal 28 for long periods even if the battery 53 is relatively small. In certain embodiments, multiple wireless charging pads 61 may be provided on the marine vessel 12 such as at key locations, so that the operator can have options for locations where the foot pedal 28 can be powered. Each wireless charging pad 61 may be connected to the battery 63.

The wireless charging system may implement any of various wireless charging technologies, such as inductive charging, Wi-Power, or other near-field wireless energy transfer technologies, such as eCoupled. In one embodiment, the wireless charging pad 61 includes a transmission coil that transfers energy to a receiving coil in the foot pedal 28 when the receiving coil is near the transmission coil, and thus within the magnetic field created by the transmission coil, so as to provide wireless power transfer thereto to charge the battery 53 of the wireless foot pedal 28. Accordingly, a wireless foot pedal 28 can be provided that incorporates haptic feedback technologies without having to increase the battery size within the foot pedal 28 and without requiring that the user change the battery frequently or stop using the foot pedal 28 in order to change or recharge the batteries.

In still other examples, the transmission 48 is directly mounted to the trolling motor mounting bracket, which may be configured differently than that shown in FIG. 1, instead of in the head unit 24. For example, FIG. 6 shows an example like FIG. 4, but where the transmission 48 and position sensor 50 are directly mounted to the mounting bracket 70. The controller 26 may still be located in the head unit 24, or the controller 26 may be located on or near the mounting bracket 70. In other examples, the controller 26 is located remotely from the remainder of the trolling motor system 9 and communicates wirelessly therewith. The example of FIG. 7 shows the transmission 48 and associated position sensor 50, as well as the controller 26, cable drum 60, position sensor 51, and variable resistance device 52, being directly attached to or located within the mounting bracket 70. The controller 26 could instead be located in the head unit 24. In both the examples of FIGS. 6 and 7, the components operate in the same manner as that described herein above with respect to FIGS. 4 and 5, respectively, and the embodiments shown differ only in the locations of the system components.

What is claimed is:

1. A trolling motor system comprising:

a trolling motor having a steering motor coupled in torque transmitting relationship with a steering shaft, the steering shaft being coupled to a lower propulsion unit such that rotation of the steering shaft results in rotation of the lower propulsion unit about a steering axis;

a controller in signal communication with the steering motor;

a foot pedal in signal communication with the controller, the foot pedal being configured to send electrical steering signals to the controller to control the steering motor;

a battery in the foot pedal; and a wireless charging pad configured to charge the battery in the foot pedal.

2. The trolling motor system of claim 1, wherein the foot pedal has a foot pad pivotable about a pivot axis, and the electrical steering signals are sent to the controller in response to pivoting of the foot pad;

further comprising a variable resistance device coupled to the foot pedal and controllable to vary resistance to pivoting of the foot pad about the pivot axis based on at least one of a position, velocity, acceleration, and jerk of the steering shaft about the steering axis.

3. The trolling motor system of claim 2, further comprising a position sensor sensing an angular position of the steering shaft about the steering axis, wherein the position sensor is in signal communication with the controller, and the controller uses measurements from the position sensor to determine the at least one of the position, velocity, acceleration, and jerk of the steering shaft.

4. The trolling motor system of claim 3, wherein the variable resistance device is an electric motor located on the foot pedal.

5. The trolling motor system of claim 4, wherein the electric motor is configured to change a position of the foot pad about the pivot axis to correspond to the sensed angular position of the steering shaft about the steering axis.

6. The trolling motor system of claim 2, wherein the variable resistance device is located on the foot pedal.

7. The trolling motor system of claim 6, wherein the controller is configured to control the variable resistance device to provide haptic feedback to a user via the foot pad to inform the user about a non-steering related status of at least one of the trolling motor and the foot pedal.

8. The trolling motor system of claim 2, wherein the variable resistance device is configured to increase the resistance to pivoting of the foot pad about the pivot axis in response to an increase in at least one of the velocity, acceleration, and jerk of the steering shaft about the steering axis.

9. A trolling motor system comprising:

a trolling motor having a steering motor coupled in torque transmitting relationship with a steering shaft, the steering shaft being coupled to a lower propulsion unit such that rotation of the steering shaft results in rotation of the lower propulsion unit about a steering axis;

a controller in signal communication with the steering motor;

a foot pedal in signal communication with the controller, the foot pedal being configured to send electrical steering signals to the controller to control the steering motor; and a remote control device having a motor in signal communication with the controller, wherein the controller is configured to control the motor to provide haptic feedback to a user via the remote control device to inform the user about a status of the trolling motor system.

10. The trolling motor system of claim 9, further comprising a GPS receiver in signal communication with the controller, wherein the controller is configured to control the motor to provide haptic feedback to the user via the remote control device to inform the user that a predetermined GPS location has been reached, that a GPS signal has been lost, or that the trolling motor has deviated from a predetermined GPS location.

11. The trolling motor system of claim 9, further comprising a sonar in signal communication with the controller, wherein the controller is configured to control the motor to provide haptic feedback to the user via the remote control device to inform the user that the trolling motor is approaching a submerged object, that a fish has been located via the sonar, or that the trolling motor is operating in water of a predetermined depth.

12. A foot pedal for a trolling motor system, the foot pedal comprising:

a foot pad pivotable about a pivot axis; and a variable resistance device on the foot pedal and controllable to vary resistance to pivoting of the foot pad about the pivot axis;

wherein the foot pedal is configured for signal communication with a controller that controls a steering motor of a trolling motor, the steering motor being coupled in torque transmitting relationship with a steering shaft of the trolling motor, the steering shaft being coupled to a lower propulsion unit such that rotation of the steering shaft results in rotation of the lower propulsion unit about a steering axis;

wherein the foot pedal is configured to send electrical steering signals to the controller in response to pivoting of the foot pad about the pivot axis to thereby control the steering motor; and wherein the variable resistance device varies resistance to pivoting of the foot pad about the pivot axis based on at least one of a position, velocity, acceleration, and jerk of the steering shaft about the steering axis.

13. The foot pedal of claim 12, wherein the variable resistance device is an electric motor.

14. The foot pedal of claim 13, wherein the electric motor is configured to change a position of the foot pad about the pivot axis to correspond to a sensed angular position of the steering shaft about the steering axis.

15. The foot pedal of claim 14, wherein a position sensor is configured to sense the angular position of the steering shaft about the steering axis, wherein the position sensor is configured for signal communication with the controller, and wherein the controller uses measurements from the position sensor to determine the at least one of the position, velocity, acceleration, and jerk of the steering shaft about the steering axis.

16. The foot pedal of claim 12, further comprising a battery in the foot pedal, wherein the battery is configured to be charged by a wireless charging pad.

17. The foot pedal of claim 12, wherein the controller is configured to control the variable resistance device to provide haptic feedback to a user via the foot pad to inform the user about a non-steering related status of at least one of the trolling motor and the foot pedal.

18. The foot pedal of claim 12, wherein the variable resistance device is configured to increase the resistance to pivoting of the foot pad about the pivot axis in response to an increase in at least one of the velocity, acceleration, and jerk of the steering shaft about the steering axis.

* * * * *